US009194676B1

(12) United States Patent
Masinelli

(10) Patent No.: US 9,194,676 B1
(45) Date of Patent: Nov. 24, 2015

(54) HOLLOW POINT BULLET

(71) Applicant: Olin Corporation, St. Louis, MO (US)

(72) Inventor: Kyle A. Masinelli, Staunton, IL (US)

(73) Assignee: OLIN CORPORATION, St. Louis, MO (US)

( * ) Notice: Subject to any disclaimer, the term of this patent is extended or adjusted under 35 U.S.C. 154(b) by 0 days.

(21) Appl. No.: 14/307,476

(22) Filed: Jun. 17, 2014

(51) Int. Cl.
*F42B 12/02* (2006.01)
*F42B 12/34* (2006.01)
*F42B 5/02* (2006.01)

(52) U.S. Cl.
CPC ..... *F42B 12/34* (2013.01); *F42B 5/025* (2013.01)

(58) Field of Classification Search
CPC ..... F42B 12/34; F42B 12/78
USPC ..... 102/439, 507–510, 514
See application file for complete search history.

(56) References Cited

U.S. PATENT DOCUMENTS

| | | | | | |
|---|---|---|---|---|---|
| 4,550,662 | A * | 11/1985 | Burczynski | ..... | 102/509 |
| 4,805,535 | A * | 2/1989 | Marcon | ..... | 102/503 |
| 4,829,906 | A * | 5/1989 | Kaswer | ..... | 102/514 |
| 4,995,318 | A * | 2/1991 | Stidston et al. | ..... | 102/503 |
| 5,187,325 | A * | 2/1993 | Garvison | ..... | 102/509 |
| 5,357,866 | A * | 10/1994 | Schluckebier et al. | ..... | 102/509 |
| 6,805,057 | B2 * | 10/2004 | Carr et al. | ..... | 102/509 |
| 7,966,937 | B1 * | 6/2011 | Jackson | ..... | 102/517 |

* cited by examiner

*Primary Examiner* — Bret Hayes
(74) *Attorney, Agent, or Firm* — Harness, Dickey & Pierce, P.L.C.

(57) ABSTRACT

A bullet having a metal jacket, having a generally cylindrical aft section, a tapering forward section, and an open front. A soft, dense, metal core is disposed in the metal jacket. The core has a cavity generally aligned with the open front of the jacket, with a plurality of blades extending forwardly into the cavity, each terminating in a front face at or spaced rearwardly of the forward edge of the metal jacket.

20 Claims, 2 Drawing Sheets

HOLLOW POINT BULLET

FIELD

The present disclosure relates to BULLET.

BACKGROUND

This section provides background information related to the present disclosure which is not necessarily prior art.

This invention relates to bullets, and in particular to a hollow point bullets.

Hollow point bullets have a cavity at the front of the bullet which facilitates the expansion of the bullet after it impacts its target. However, a problem with at least some hollow point bullets is that with some materials, such as wall board, the bullets don't expand as intended, and thus the performance and penetration is unpredictable. For many users, including but not limited to law enforcement users, it is important that a bullet perform predictably and consistently, to avoid unintended consequence. In fact the FBI has developed a test protocol (as of 2014) that measures a bullet's performance in a variety of materials:

Test event 1—Bare Gelatin

Gelatin block 10 feet from muzzle

Test event 2—Heavy Clothing

Gelatin block covered with four layers of clothing 10 feet from muzzle.

Layer one—Sew Classic Knits T-shirt

Layer two—Symphony broad cloth—Dress Shirt

Layer three—Polartec Fleece 200

Layer four—14 oz Bull Denim

Test event 3—Steel

Two pieces of 20 gauge cold rolled galvanized steel

Gel block is covered in one layer of cotton t-shirt and one layer of cotton shirt from above Gel block is 18 inches behind the rear most piece of steel with the block 10 feet from muzzle.

Test event 4-Wallboard Two square pieces each ½ inch thick gypsum wallboard set 3.5 inches apart. Gel block is covered in one layer of cotton t-shirt and one layer of cotton shirt.

Gel block is 18 inches behind the rear most piece of wall board with the block 10 feet from muzzle.

Test event 5—Plywood

One square piece of 23/32 sanded pine plywood

Gel block is covered in one layer of cotton t-shirt and one layer of cotton shirt.

Gel block is 18 inches behind the rear of plywood with the block 10 feet from muzzle.

Test event 6—Auto Glass

One piece of A.S.I ¼ inch thick laminated safety glass measuring 15×18 inches.

Glass set at an angle of 45 degrees with the horizontal

Line of bore of barrel is offset 15 degrees to the side to imitate a compound angle of impact with the glass.

Gel block is covered in one layer of cotton t-shirt and one layer of cotton shirt.

Gel block is 18 inches behind the glass with the block 10 feet from muzzle.

SUMMARY

This section provides a general summary of the disclosure, and is not a comprehensive disclosure of its full scope or all of its features.

Embodiments of the present invention provide a hollow point, expanding bullet, with improved performance in certain types of materials, and therefore improved consistency in performance. Generally a preferred embodiment of a bullet in accordance with the present invention comprises a metal jacket, having a generally cylindrical aft section, a tapering forward section, and an open front. There is a soft, dense, metal core disposed in the metal jacket. The core has a cavity generally aligned with the open front of the jacket, with a plurality of blades extending forwardly into the cavity, each terminating in a front face spaced rearwardly of the forward edge of the metal jacket.

In this preferred embodiment there are preferably at least three blades, each oriented along radius of the cavity, and the blades are preferably equally angularly spaced. The front faces of the blades are preferably spaced between about 0 and about 0.125 inches from the forward most edge of the opening in the jacket. In the preferred embodiment the area of the front faces of the blades comprises between about 35% and about 55% of the cross-sectional area of the cavity (in the plane of the front faces of the blades).

The blades preferably have a height of between about 0.060 and about 0.200 inches, which is preferably between about 30% and about 100% of the distance between the bottom of the cavity and the forward-most edge of the opening in the jacket. The cavity preferably has a volume of at least 0.0015 $in^3$, and the blades preferably comprise at least 20% of the volume. The blades can be formed integrally with the core, or can comprise a separate piece formed in, or inserted into, the cavity.

The jacket preferably comprises copper or a copper alloy, although it could be made of other suitable material. The core preferably comprises lead or a lead alloy, although though it could be made of another relative soft, relatively dense metal, particularly if it is desired that the bullet be lead free.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
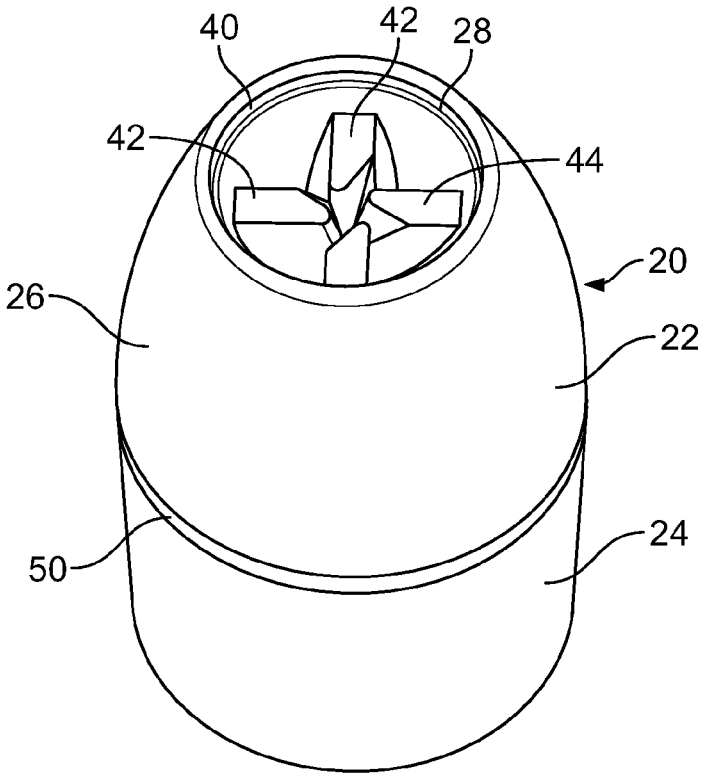
FIG. 1 is perspective view of a preferred embodiment of a bullet in accordance with the principles of this invention.

Example embodiments will now be described more fully with reference to the accompanying drawings.

A preferred embodiment of a bullet in accordance with the principles of this invention is indicated generally as 20 in the Figures. The bullet 20 comprises a metal jacket 22, having a generally cylindrical aft section 24, a tapering forward section 26, and an open front 28. The jacket can be made of copper or a copper alloy, or other suitable material.

A metal core 30, preferably of a relatively soft, dense material such as lead or a lead alloy, is disposed in the metal jacket 22. The core 30 having a cavity 40 generally aligned with the open front 28 of the jacket 22. A plurality of blades 42 are disposed in the cavity 40, each to terminating in a front face 44 that is spaced rearwardly of the forward edge of the metal jacket 22. Although preferably made of lead, the core 30 could be made of another suitable relatively soft, dense material, particularly if it is desired to make the bullet "lead free."

There are preferably at least three blades 42, each oriented along radius of the cavity 40. The blades 40 are preferably equally angularly spaced (for example in the case of three blades, the spacing is 120°, and in the case of four blades the spacing is 90°). The front faces 44 of the blades 42 are preferably spaced between about 0 and about 0.125 inches from the forward most edge of the opening 28 in the jacket 22. Preferably, the area of the front faces 42 of the blades 42 comprise about 35% and about 55% of the cross-sectional area of the cavity 40 (measured in the plane of the front faces 44 of the blades 42).

The blades can have a height of between about 0.060 and about 0.200 inches, which is preferably between about 30% and about 100% of the distance between the bottom of the cavity 40 and the forward-most edge of the opening 28 in the jacket 22. In the preferred embodiment the cavity 40 has a volume of at least 0.0015 $in^3$, and the blades 42 comprise at least 20% of the volume.

In the preferred embodiment that blades 42 are formed integrally of the core material, but alternatively the blades could be formed separately and inserted into the cavity 40. In this case the blades 42 could be made of the same material as the core 30, the jacket 22, or some other material such as a metal or even a polymeric or other suitable material.

Figure 2:
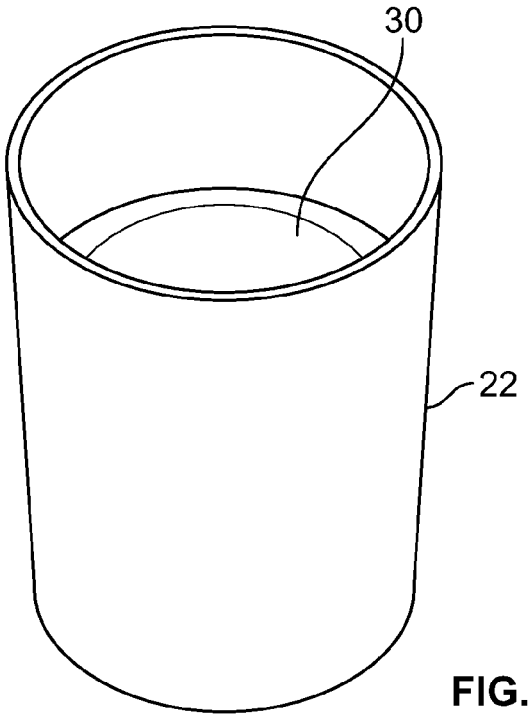
FIG. 2 is a perspective view of a cup and core used in the manufacture of bullets of the preferred embodiment.
Figure 3:
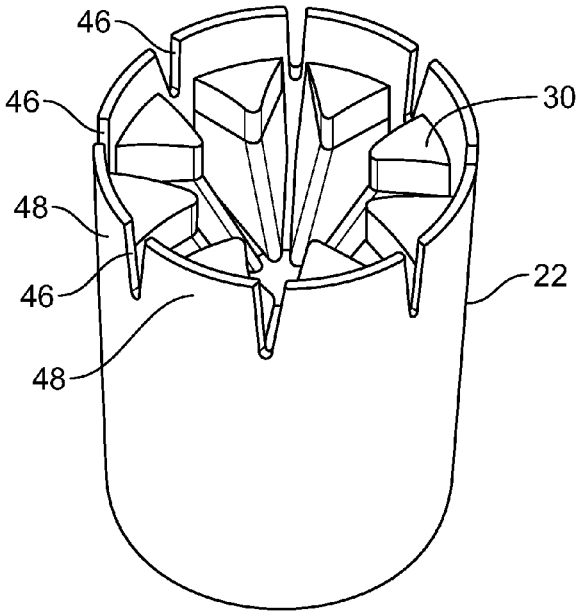
FIG. 3 is a perspective view of the cup and core after forming flaps in the cup and wedges in the core.

Bullets 20 of the preferred embodiment can be formed by drawing a copper or copper alloy into a cup shape, as shown in FIG. 2, and then inserting a preformed core 30, or pouring molten metal into the cup to cast the core in situ. The jacket and core preform is then punched with an eight bladed tool that cuts eight slits 46 into the sidewall of the jacket 22 forming eight flaps 48, and makes a eight-pointed star shaped imprint in the core material, forming eight wedge-shaped segments, as shown in FIG. 3. Of course the jacket and core could be formed with fewer or more slits, for example as few as four or as many as ten. It is preferable that there be an even number of slits. A tool is interested into the end of the cup, and the flaps compressed to form the tapered forward portion of the bullet, and the eight wedge shaped segments formed into four blades, as shown in the finished bullet in FIG. 1.

The bullet can further be subjected to a knurling operation to lock the jacket onto the core. A knurl 50 can improve weight retention when the bullet is fired through certain barriers such as autoglass.

Operation

Figure 4:
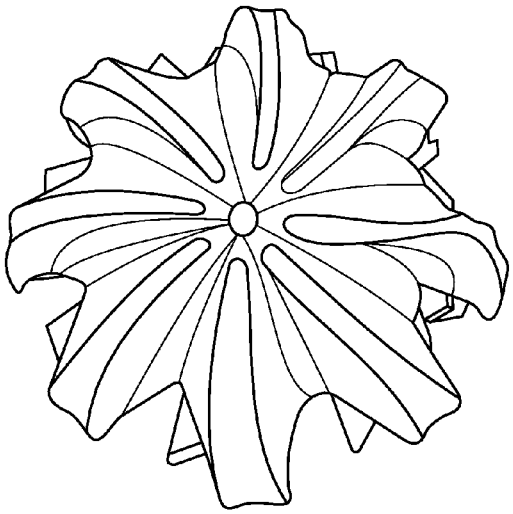
FIG. 4 is a photograph of a recovered projectile made from the cup and core shown in FIGS. 1 and 2, but without blades, after being fired into the FBI heavy clothing barrier, and penetrating 13.25"
Figure 5:
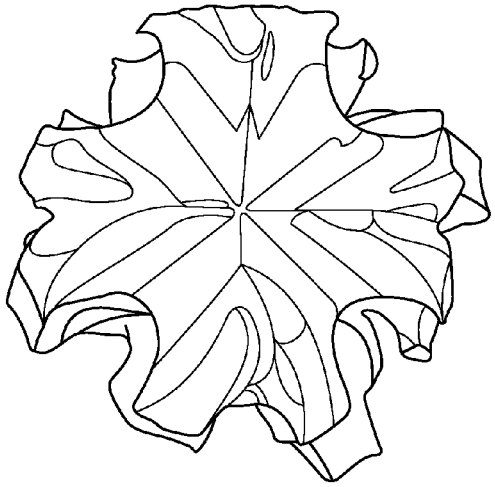
FIG. 5 is a photographs of a recovered projectile of the preferred embodiment, after being fired into the FBI heavy clothing barrier, and penetrating 16.5".

In operation, the blades 42 significantly improve the performance and consistency of the bullet compared to a hollow point bullet without the blades. FBI Protocol data for a hollow point bullet without the blades is shown in Table 1, while data for a hollow point bullet with the blades is shown in Table 2. The composite score for the convention hollow point bullet is 345 out of 500, while the composite score for the bladed hollow point bullet is 390 out of 500. A 45 point (11.5%) improvement. Tables 3A and 3B show the velocities for the testing shown in Tables 1 and 2, respectively. Tables 4A and 4B summarize the results shown in Tables 1 and 2, The blades provide an improvement in the FBI protocol score by increasing the projectile penetration without greatly sacrificing the overall expanded diameter. Deeper penetration increases the score by eliminating any shots that penetrate less than 12" which the protocol penalizes. In addition, it reduces the penetration standard deviation by allowing the "soft" barrier (bare gelatin & heavy cloth) penetrations to be more similar to the "hard" barrier penetrations such as steel. This is exemplified in FIGS. 4 and 5, which show expanded bullets that were fired into the heavy clothing barrier, the bullet constructed according to the principles of this invention penetrated 3.25" deeper.

TABLE 1

| FBI Protocol Testing PT4289 - E.O. 8517 Sample I | | | | | | | | | |
|---|---|---|---|---|---|---|---|---|---|
| | | | Expansion | | | | | | |
| | Penetration | Retained Wt. | Min | Max | Average | <12" | Gel Block | BB Qualification | |
| Bare | 12.25 | 230.6 | 0.819 | 0.843 | 0.831 | | 1 | Velocity | Pene. |
| Event #1 | 12.00 | 230.0 | 0.816 | 0.878 | 0.847 | | 1 | | |
| | 13.00 | 230.5 | 0.842 | 0.857 | 0.850 | | 1 | 587 | 3.39 |
| | 11.75 | 230.3 | 0.850 | 0.894 | 0.872 | 1 | 2 | 591 | 3.35 |
| | 13.50 | 231.3 | 0.822 | 0.844 | 0.833 | | 2 | | |
| Heavy | 14.75 | 228.9 | 0.738 | 0.749 | 0.744 | | 3 | Velocity | Pene. |
| Cloth | 14.00 | 231.4 | 0.752 | 0.782 | 0.767 | | 3 | | |
| Event #2 | 14.00 | 229.7 | 0.758 | 0.767 | 0.763 | | 3 | 590 | 3.31 |
| | 14.00 | 231.0 | 0.753 | 0.776 | 0.765 | | 4 | 591 | 3.45 |
| | 13.25 | 230.5 | 0.773 | 0.799 | 0.786 | | | | |
| Steel | 18.00 | 229.7 | 0.508 | 0.532 | 0.520 | | 5 | Velocity | Pene. |
| Event #3 | 18.00 | 231.0 | 0.501 | 0.509 | 0.505 | | 5 | 585 | 3.15 |
| | 18.00 | 230.5 | 0.505 | 0.520 | 0.513 | | 6 | 591 | 3.68 |
| | 18.00 | 230.5 | 0.511 | 0.523 | 0.517 | | 6 | | |
| | 16.00 | 230.3 | 0.523 | 0.535 | 0.529 | | 6 | | |
| Wall | 12.50 | 228.5 | 0.725 | 0.760 | 0.743 | | 7 | 583 | 3.30 |
| Board | 13.50 | 231.5 | 0.747 | 0.762 | 0.755 | | 8 | 580 | 3.05 |
| Event #4 | 13.25 | 229.9 | 0.732 | 0.766 | 0.749 | | 8 | | |
| | 14.00 | 230.4 | 0.733 | 0.781 | 0.757 | | 9 | 581 | 3.20 |
| | 14.00 | 228.2 | 0.740 | 0.770 | 0.755 | | 9 | | |

TABLE 1-continued

| | FBI Protocol Testing PT4289 - E.O. 8517 Sample I | | | | | | | | |
|---|---|---|---|---|---|---|---|---|---|
| | | | Expansion | | | | | | |
| | Penetration | Retained Wt. | Min | Max | Average | <12" | Gel Block | BB Qualification | |
| Ply- | 15.25 | 230.0 | 0.720 | 0.763 | 0.742 | | 10 | Velocity | Pene. |
| Wood | 15.50 | 228.7 | 0.742 | 0.783 | 0.763 | | 10 | 586 | 3.23 |
| Event #5 | 16.50 | 229.1 | 0.566 | 0.715 | 0.641 | | 11 | 592 | 3.63 |
| | 20.00 | 230.1 | 0.566 | 0.740 | 0.653 | | 11 | | |
| | 14.25 | 229.8 | 0.527 | 0.654 | 0.591 | | 11 | | |
| Auto | 13.25 | 159.4 | 0.550 | 0.634 | 0.592 | | 12 | Velocity | Pene. |
| Glass | 13.25 | 158.4 | 0.475 | 0.649 | 0.552 | | 12 | 591 | 3.04 |
| Event #6 | 13.25 | 161.5 | 0.483 | 0.579 | 0.531 | | 13 | 583 | 3.16 |
| | 14.50 | 157.8 | 0.504 | 0.616 | 0.560 | | 13 | | |
| | 14.50 | 157.9 | 0.518 | 0.637 | 0.578 | | 13 | | |
| Avg. | 14.633 | 218.2 | | | 0.687 | 1 | | | |
| Std. Dev | 2.083 | 94.89% | | | | | | | |
| Points | 10 | 9 | | | 7 | 8 | | | |
| Std. Dev Pts | 0.6 | | | | | | | | |
| | 3 | 0.9 | | | 1.4 | 1.5 | | | |

TABLE 2

| | FBI Protocol Testing PT4623 - E.O. 8517 Sample K | | | | | | | | |
|---|---|---|---|---|---|---|---|---|---|
| | | | Expansion | | | | | | |
| | Penetration | Retained Wt. | Min | Max | Average | <12" | Gel Block | BB Qualification | |
| Bare | 14.50 | 227.6 | 0.700 | 0.752 | 0.726 | | 1 | Velocity | Pene. |
| Event #1 | 14.00 | 230.6 | 0.710 | 0.769 | 0.740 | | 1 | 588 | 3.42 |
| | 15.00 | 229.8 | 0.699 | 0.735 | 0.717 | | 1 | | |
| | 13.50 | 229.2 | 0.698 | 0.733 | 0.716 | | 1 | | |
| | 13.50 | 230.1 | 0.707 | 0.771 | 0.739 | | 1 | | |
| Heavy | 16.50 | 230.3 | 0.659 | 0.751 | 0.705 | | 1 | Velocity | Pene. |
| Cloth | 15.00 | 231.5 | 0.698 | 0.748 | 0.723 | | 1 | 588 | 3.42 |
| Event #2 | 15.50 | 230.2 | 0.688 | 0.749 | 0.719 | | 1 | | |
| | 15.50 | 231.4 | 0.691 | 0.790 | 0.741 | | 1 | | |
| | 16.50 | 230.6 | 0.681 | 0.722 | 0.702 | | 1 | | |
| Steel | 19.75 | 230.1 | 0.494 | 0.509 | 0.502 | | 1 | Velocity | Pene. |
| Event #3 | 20.25 | 230.2 | 0.476 | 0.490 | 0.483 | | 1 | 588 | 3.42 |
| | 13.50 | 230.4 | 0.593 | 0.609 | 0.601 | | 2 | 588 | 3.36 |
| | 18.00 | 230.5 | 0.504 | 0.513 | 0.509 | | 2 | | |
| | 13.75 | 230.7 | 0.589 | 0.620 | 0.605 | | 2 | | |
| Wall | 15.75 | 231.6 | 0.748 | 0.771 | 0.760 | | 2 | 588 | 3.36 |
| Board | 14.25 | 232.2 | 0.685 | 0.765 | 0.725 | | 2 | | |
| Event #4 | 16.50 | 232.0 | 0.726 | 0.746 | 0.736 | | 2 | | |
| | 13.50 | 231.4 | 0.768 | 0.772 | 0.770 | | 2 | | |
| | 14.25 | 230.5 | 0.688 | 0.810 | 0.749 | | 2 | Velocity | Pene. |
| Ply- | 19.75 | 231.0 | 0.508 | 0.650 | 0.579 | | 2 | 586 | 3.36 |
| Wood | 18.00 | 232.0 | 0.760 | 0.801 | 0.781 | | 2 | | |
| Event #5 | 16.75 | 232.9 | 0.666 | 0.785 | 0.726 | | 2 | | |
| | 17.25 | 230.7 | 0.625 | 0.818 | 0.722 | | 2 | | |
| | 16.50 | 233.2 | 0.735 | 0.799 | 0.767 | | 2 | Velocity | Pene. |
| Auto | 13.25 | 148.4 | 0.411 | 0.641 | 0.526 | | 3 | 576 | 3.55 |
| Glass | 15.00 | 156.1 | 0.491 | 0.655 | 0.573 | | 3 | | |
| Event #6 | 17.25 | 166.8 | 0.545 | 0.653 | 0.599 | | 3 | | |
| | 16.00 | 154.0 | 0.436 | 0.639 | 0.538 | | 3 | | |
| | 16.00 | 155.3 | 0.421 | 0.627 | 0.524 | | 3 | | |
| Avg. | 15.825 | 218.4 | | | 0.667 | 0 | | | |
| Std. Dev | 1.974 | 94.95% | | | | | | | |
| Points | 10 | 9 | | | 7 | 10 | | | |
| Std. Dev Pts | 0.7 | | | | | | | | |
| | 3.5 | 0.9 | | | 1.4 | 2 | | | |

TABLE 3A

| | Velocity |
|---|---|
| Bare | 904 |
| | 922 |
| | 912 |

TABLE 3A-continued

| | Velocity |
|---|---|
| | 931 |
| | 895 |
| Heavy Cloth | 910 |

TABLE 3A-continued

| | Velocity |
|---|---|
| | 925 |
| | 898 |
| | 906 |
| | 891 |
| Steel | 912 |
| | 921 |
| | 905 |
| | 908 |
| | 894 |
| Wallboard | 896 |
| | 916 |
| | 925 |
| | 864 |
| | 924 |
| Plywood | 919 |
| | 918 |
| | 904 |
| | 925 |
| | 898 |
| Auto Glass | 904 |
| | 897 |
| | 909 |
| | 901 |
| | 929 |

TABLE 3B

| | Velocity |
|---|---|
| Bare | 912 |
| | 902 |
| | 889 |
| | 894 |
| | 900 |
| Heavy Cloth | 892 |
| | 906 |
| | 892 |
| | 883 |
| | 902 |
| Steel | 898 |
| | 887 |
| | 857 |
| | 876 |
| | 882 |
| Wallboard | 888 |
| | 896 |
| | 897 |
| | 900 |
| | 891 |
| Plywood | 888 |
| | 901 |
| | 894 |
| | 898 |
| | 899 |
| Auto Glass | 880 |
| | 916 |
| | 913 |
| | 905 |
| | 909 |

TABLE 4A

| Summary | | | | |
|---|---|---|---|---|
| Barrier | Penetration | Ret. Weight | Expansion | Pen Std. Dev |
| Bare Gel | 12.50 | 230.53 | 0.847 | 0.729 |
| Heavy Cloth | 14.00 | 230.29 | 0.765 | 0.530 |
| Steel | 17.60 | 230.44 | 0.517 | 0.894 |
| Wallboard | 13.45 | 229.70 | 0.752 | 0.622 |
| Plywood | 16.50 | 229.55 | 0.678 | 2.172 |
| Autoglass | 13.75 | 158.99 | 0.565 | 0.685 |
| Avg. | 14.63 | 218.25 | 0.687 | |

TABLE 4B

| Summary | | | | |
|---|---|---|---|---|
| Barrier | Penetration | Ret. Weight | Expansion | Pen Std. Dev |
| Bare Gel | 14.10 | 229.47 | 0.727 | 0.652 |
| Heavy Cloth | 15.80 | 230.82 | 0.718 | 0.671 |
| Steel | 17.05 | 230.41 | 0.540 | 3.237 |
| Wallboard | 15.05 | 231.53 | 0.748 | 1.473 |
| Plywood | 17.65 | 231.95 | 0.715 | 1.306 |
| Autoglass | 15.30 | 156.32 | 0.552 | 1.473 |
| Avg. | 15.83 | 218.42 | 0.667 | |

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A bullet comprising:

a metal jacket, having a generally cylindrical aft section, a tapering forward section, and an open front;

a soft, dense, metal core disposed in the metal jacket, the core having a cavity generally aligned with the open front of the metal jacket, with a plurality of blades extending forwardly into the cavity, each terminating in a front face spaced rearwardly of a forward-most edge of the metal jacket.

2. The bullet according to claim 1 wherein there are at least three blades, each oriented along radius of the cavity.

3. The bullet according to claim 2 wherein the blades are equally angularly spaced.

4. The bullet according to claim 3 wherein there are four blades.

5. The bullet according to claim 1 wherein the front faces of the blades are spaced between about 0 and about 0.125 inches from the forward most edge of the opening in the jacket.

6. The bullet according to claim 1 wherein the area of the front faces of the blades comprises between about 35% and about 55% of the cross-sectional area of the cavity in the plane of the front faces of the blades.

7. The bullet according to claim 1 wherein the blades have a height of between about 0.060 and about 0.200 inches.

8. The bullet according to claim 1 wherein the blades have a height of between about 30% and about 100% of the distance between the bottom of the cavity and the forward-most edge of the opening in the jacket.

9. The bullet according to claim 1 wherein the jacket comprises copper or a copper alloy.

10. The bullet according to claim 1 wherein the core comprises lead or a lead alloy.

11. The bullet according to claim 1 wherein the cavity has a volume of at least 0.0015 $in^3$, and the blades comprise at least 20% of the volume.

12. A bullet comprising:

a metal jacket, having a generally cylindrical aft section, a tapering forward section, and an open front;

a soft, dense, metal core disposed in the metal jacket, the core having a cavity generally aligned with the open front, with a plurality of blades extending forwardly into the cavity, each oriented along radius of the cavity and equally angularly spaced from each other, the blades terminating in a front face spaced rearwardly of a forward-most edge of the metal jacket.

13. The bullet according to claim 12 wherein there are four blades.

14. The bullet according to claim 12 wherein the front faces of the blades are spaced between about 0 and about 0.125 inches from the forward-most edge of the opening in the jacket.

15. The bullet according to claim 14 wherein the area of the front faces of the blades comprises between about 35% and about 55% of the cross-sectional area of the cavity in the plane of the front faces of the blades.

16. The bullet according to claim 14 wherein the blades have a height of between about 0.060 and about 0.200 inches.

17. The bullet according to claim 14 wherein the blades have a height of between about 30% and about 100% of the distance between the bottom of the cavity and the forward-most edge of the opening in the jacket.

18. The bullet according to claim 14 wherein the jacket comprises copper or a copper alloy.

19. The bullet according to claim 18 wherein the core comprises lead or a lead alloy.

20. The bullet according to claim 14 wherein the cavity has a volume of at least 0.0015 $in^3$, and the blades comprise at least 20% of the volume of the volume.

* * * * *